US006777381B1

(12) United States Patent
Aouad et al.

(10) Patent No.: US 6,777,381 B1
(45) Date of Patent: Aug. 17, 2004

(54) PROCESS FOR MAKING DETERGENT COMPOSITIONS WITH ADDITIVES

(75) Inventors: Yousef Georges Aouad, Cincinnati, OH (US); Rudolfo Delgado, Cincinnati, OH (US); Andrew Peter Bakken, Appleton, WI (US)

(73) Assignee: The Procter & Gamble Company, Cincinnati, OH (US)

( * ) Notice: Subject to any disclaimer, the term of this patent is extended or adjusted under 35 U.S.C. 154(b) by 159 days.

(21) Appl. No.: 10/048,079

(22) PCT Filed: Aug. 2, 2000

(86) PCT No.: PCT/US00/20991

§ 371 (c)(1),
(2), (4) Date: Jan. 24, 2002

(87) PCT Pub. No.: WO01/09273

PCT Pub. Date: Feb. 8, 2001

Related U.S. Application Data

(60) Provisional application No. 60/146,954, filed on Aug. 3, 1999.

(51) Int. Cl.[7] ..... C11D 17/00

(52) U.S. Cl. ..... 510/404; 510/405; 510/407; 510/414; 510/444; 510/457; 510/427; 510/432

(58) Field of Search ..... 510/404–407, 510/414, 427, 432, 457; 8/444, 457, 405, 407, 414

(56) References Cited

U.S. PATENT DOCUMENTS

| | | | | |
|---|---|---|---|---|
| 3,981,826 A | | | 9/1976 | Munro |
| 5,759,981 A | | | 6/1998 | Boutique et al. |
| 5,814,592 A | | * | 9/1998 | Kahn et al. |
| 5,872,092 A | | | 2/1999 | Kong-Chan et al. |
| 5,945,392 A | | | 8/1999 | Boutique et al. |
| 6,165,959 A | | | 12/2000 | Meyer et al. |
| 6,207,634 B1 | | | 3/2001 | Meyer et al. |
| 6,239,094 B1 | | | 5/2001 | Goderis et al. |
| 6,277,804 B1 | | | 8/2001 | Kahn et al. |
| 6,281,187 B1 | | | 8/2001 | Smerznak |

FOREIGN PATENT DOCUMENTS

| | | |
|---|---|---|
| WO | WO 92/09678 | 6/1992 |
| WO | WO 98/00516 | 1/1998 |
| WO | WO 98/00518 | 1/1998 |

OTHER PUBLICATIONS

Tyzack J, "Applications for atfes–drying and concentration", Chemical Engineering, Nov. 15, 1990, pp. 33, 35, 37–38, No. 485, McGraw–Hill, Albany, NY.

* cited by examiner

*Primary Examiner*—Margaret Einsmann
(74) *Attorney, Agent, or Firm*—Armina E. Mathews; Brahm J. Corstanje; Kim William Zerby

(57) ABSTRACT

Process incorporating an organic solvent and being composed of detergent components present together within specific ranges have now been found so as to produce a non-aqueous liquid detergent composition without the attendant drawbacks of non-aqueous liquids. In particular, this process produces a liquid detergent composition which is easy to handle in bulk, has excellent long-term stability and is readily soluble in a wash liquor.

17 Claims, 2 Drawing Sheets

PROCESS FOR MAKING DETERGENT COMPOSITIONS WITH ADDITIVES

RELATED APPLICATIONS

This application claims priority to International Application Ser. No. PCT/US00/20991 which was filed on Aug. 2, 2000, which claims benefit of Ser. No. 60/146,954 filed Aug. 3, 1999.

FIELD OF THE INVENTION

The present invention relates to processes for making non-aqueous liquid laundry detergent products which contain an organic anhydrous solvent, an anionic sulfonated surfactant as well as other conventional detergent composition adjuvants and which are in the form of a Newtonian liquid, as well as the drying of (removing water from) detergent ingredients, especially polymers, surfactants and/or solvents, more especially polymers and surfactants for use in detergent compositions. In addition to the above, the present invention also provides a means of converting Newtonian liquids into non-Newtonian liquids and non-Newtonian liquids into Newtonian liquids.

BACKGROUND OF THE INVENTION

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Additionally, liquid laundry detergents may have incorporated into their formulations materials which would deteriorate in the drying operations employed in the manufacture of particulate or granular laundry detergent products. Because liquid laundry detergents are usually considered to be more convenient to use than granular laundry detergents, they have found substantial favor with consumers.

Although liquid laundry detergents have a number of advantages over granular laundry detergent products, there are also disadvantages entailed in using them as well. In particular, laundry detergent composition components which may be compatible with each other in granular products may tend to interact or react with each other in a liquid, and especially in an aqueous liquid, environment. Components such as surfactants, perfumes, brighteners and non-aqueous solvents can be especially difficult to incorporate into liquid laundry detergent products with an acceptable degree of compositional stability. Poor compositional stability may cause the detergent composition to be prematurely reacted into the wash liquor as well as create an ineffective, heterogeneous detergent composition during storage.

One approach for enhancing the chemical compatibility and stability of liquid laundry detergent products has been to formulate non-aqueous (or anhydrous) liquid laundry detergent compositions. Generally, the chemical stability of the components of a non-aqueous liquid laundry detergent composition increases as the amount of water in the laundry detergent composition decreases. Moreover, by minimizing the amount of water in a liquid laundry detergent composition, one can maximize the surfactant activity of the composition. Non-aqueous liquid laundry detergent compositions have been disclosed in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

But non-aqueous liquid laundry detergents come with their own set of disadvantages and problems. The desirable advantage of having excellent compositional stability, may mean simultaneously that the non-aqueous liquid laundry detergent will have poor solubility and dispersion properties in the wash liquor inside an automatic clothes washer. Also non-aqueous liquids typically have awkward rheological properties, displaying a tendency known as "shear thickening", where the viscosity of the paste or liquid increases with an increasing shear rate making the paste difficult to pump, store and transport. Moreover, non-aqueous liquid laundry detergent compositions are difficult and expensive to manufacture. A drying step requiring prolonged heating and stirring is necessary to eliminate the water, but not only is it difficult to consistently achieve the proper heating and stirring conditions in a manufacturing setting, but such drying operations may also have the effect of decomposing or evaporating individual components of the detergent composition. The resulting difficulty and expense involved with working with such fluids has greatly reduced their utilization as laundry detergent compositions.

Given the foregoing, there is clearly a continuing need to identify and provide processes for preparing non-aqueous liquid laundry detergent products that have a high degree of chemical and compositional stability, contain the essential components of a liquid laundry detergent composition, have a high surfactant activity and are readily soluble in a wash liquor. In addition, such processes should be easily replicated at multiple production sites and should produce liquid laundry detergent products that can be easily pumped, stored and transported.

SUMMARY OF THE INVENTION

A process for preparing a solvent-based surfactant paste comprising the steps of:

A) forming an aqueous surfactant mixture by blending, by weight of the mixture:
   (a) from about 5% to about 85% of an anionic sulfonated surfactant;
   (b) from about 15% to about 95% of an organic solvent;
   (c) from about 0.001% to about 40% of a chelant;

wherein the aqueous surfactant mixture has a water content of about 5% to 80% by weight of the aqueous surfactant mixture and the aqueous surfactant mixture is a non-Newtonian fluid;

B) drying the aqueous surfactant mixture under vacuum to form the solvent-based surfactant paste having a water content of less than about 1% and which is in the form of a Newtonian fluid having a substantially constant viscosity within the range of 100 cp to 100000 cp when measured at a temperature of 25° C. and within the shear rate range of from 1 $s^{-1}$ to 1000 $s^{-1}$.

The process of above wherein the aqueous surfactant mixture may further comprise from about 0.001% to about 40% of other additives selected from the group comprising bleach, bleach activator, buffers, builders, enzymes, whiteners, rheology modifiers, polymers and copolymers, wherein the other additives are provided in the form of an aqueous solution.

The process of above wherein the aqueous surfactant mixture is dried in an evaporative column.

The process of above wherein the step of forming an aqueous surfactant mixture includes blending from about 0.001% to about 40% of an ethoxylated hexamethylene diamine quaternary ammonium compound.

The process of above wherein the step of forming an aqueous surfactant mixture includes blending from about 0.001% to about 40% of other additives selected from the group comprising bleach, bleach activator, builder, enzymes, nonionic surfactants, whiteners and polymers.

The process of above wherein the organic solvent is selected from a group consisting of alkylene glycols, diethyl- and dipropylene glycol monobutyl ethers, glycol monobutyl ether, monoethylethers, monomethylethers, monopropylethers and monobutylethers of propoxy propanol, polyethlene glycols having a molecular weight of at least about 150, methyl acetate, methyl propoinate, methyl octanoate, methyl dodecanoate and mixtures thereof.

The process of above wherein the chelant is selected from a group consisting of amino carboxylates, phosphonates, amino phosponates, polyfunctionally-substituted aromatic chelating agents and mixtures thereof.

A process for preparing a solvent-based surfactant paste comprising the steps of:

A) forming a neutralized mixture by a continuous neutralization loop, the neutralized mixture has a composition comprising:
   (a) an acid form of an anionic sulfonated surfactant and a base present in a molar ratio of from about 1:1 to about 9:1;
   (b) an organic solvent; and
   (c) a chelant;

wherein the neutralized mixture has a water content of from about 5% to about 50% by weight of the neutralized mixture and is a non-Newtonian fluid.

B) recirculating a first portion of the neutralized mixture;

C) removing a second portion of the neutralized mixture from the continuous neutralization loop;

D) drying the second portion of the neutralized mixture under vacuum to form the solvent-based surfactant paste having a water content of from about 0.2% to about 10% and which is in the form of a Newtonian fluid having a substantially constant viscosity within the range of 100 cP to 100000 cP when measured at a temperature of 25° C. and within the shear rate range of from 1 $s^{-1}$ to 1000 $s^{-1}$.

The process of above where the neutralized mixture further comprises other additives selected from the group comprising bleach, bleach activator, buffers, builders, enzymes, nonionic surfactants, whiteners, rheology modifiers, polymers and copolymers, wherein the other additives are provided in the form of an aqueous solution which has a water content of from about 5% to about 50% by weight of the neutralized mixture.

The process of above wherein the second portion of neutralized mixture is dried in an evaporative column.

The process of above wherein the acid form of an anionic surfactant is selected from a group consisting of linear alkyl benzene sulphonic acid, alkyl ethoxy sulphonic acid, alkyl polyalkylate sulphonic acid, tallow alkyl sulphonic acid and alkyl sulphonic acid.

The process of above wherein the organic solvent is selected from a group consisting of alkylene glycols, diethyl- and dipropylene glycol monobutyl ethers, glycol monobutyl ether, monoethyl-, monomethyl-, monopropyl- and monobutylethers of propoxy propanol and mixtures there of, polyethlene glycols having a molecular weight of at least about 150, methyl acetate, methyl propoinate, methyl octanoate and methyl dodecanoato.

The process of above wherein the chelant is selected from a group consisting of amino carboxylates, phosphonates, amino phosponates, polyfunctionally-substituted aromatic chelating agents and mixtures thereof.

The process of above wherein after step C additional organic solvent is added to the neutralized mixture, so that after the addition of the additional organic solvent the neutralized mixture has a water content of from about 5% to about 50% by weight of the neutralized mixture.

The process of above wherein after step C additional chelant is added to the neutralized mixture, so that after the addition of the additional chelant the neutralized mixture has a water content of from about 5% to about 50% by weight of the neutralized mixture.

A process for drying detergent ingredients comprising the steps of:

A) forming an aqueous detergent ingredient mixture by blending, by weight of the mixture wherein the aqueous detergent ingredient mixture has a water content of about 5% to 80% by weight of the aqueous detergent ingredient mixture;

B) drying the aqueous detergent ingredient mixture using an Agitated Thin Film Evaporator.

A process for converting Newtonian liquids into non-Newtonian liquids comprising the steps of:

A) forming an aqueous Newtonian liquid mixture; and

B) drying said mixture using an Agitated Thin Film Evaporator (ATFE) such that a non-Newtonian liquid is produced.

A process for converting non-Newtonian liquids into Newtonian liquids comprising the steps of:

A) forming an aqueous non-Newtonian liquid mixture; and

B) drying said mixture using an Agitated Thin Film Evaporator (ATFE) such that a Newtonian liquid is produced.

A process for preparing anhydrous agglomerates comprising the steps of:

A) producing a binder;

B) drying said binder using an Agitated Thin Film Evaporator; and

C) combining said dried binder with powders such that an agglomerate is produced.

It is a benefit of the present invention is to provide a process which produces a liquid laundry detergent composition that is easy to handle in bulk. Since it does not display shear thickening, but is in fact a Newtonian fluid over a broad range of shear rates, it is considerably easier to store, pump and transport when compared with other non-aqueous liquids.

An additional benefit of the present invention is a process for drying (removing water from) detergent ingredients, especially polymers, surfactants and/or solvents, more especially polymers and surfactants for use in detergent compositions. Such a process preferably comprises the steps of forming an aqueous detergent ingredient mixture and drying said mixture using an Agitated Thin Film Evaporator (ATFE).

Yet a further benefit of the present invention is a process for converting Newtonian liquids into non-Newtonian liquids and non-Newtonian liquids into Newtonian liquids. Such a process preferably comprises the steps of forming an aqueous Newtonian liquid mixture and drying said mixture using an Agitated Thin Film Evaporator (ATFE) such that a non-Newtonian liquid is produced. Alternatively, the process preferably comprises the steps of forming an aqueous non-Newtonian liquid mixture and drying said mixture using an Agitated Thin Film Evaporator (ATFE) such that a Newtonian liquid is produced.

An additional benefit of the present invention is to provide a process for preparing non-aqueous liquid laundry detergent products which have excellent chemical and compositional stability as well as outstanding fabric laundering performance characteristics. In addition the processes produce non-aqueous liquid laundry detergent products that are readily soluble in a wash liquor.

A further benefit is to provide a process for combining aqueous solutions of detergent components and then drying them together to produce a liquid mixture with a water level lower than what could be achieved by combining non-aqueous solutions of the components.

Still yet a further benefit of the present invention is to provide a process for preparing anhydrous agglomerates, preferably comprising organic solvents, surfactants, other detergent adjunct ingredients and/or combinations thereof, wherein the process comprises the step of producing a binder, preferably an anhydrous binder, which is preferably a highly viscous, non-Newtonian solvent based mixture of preferably one or more organic solvents, one or more surfactants, one or more chelants and/or one or more polymers, preferably anhydrous liquid polymers. In a preferred embodiment, the anhydrous binder is formed by mixing an anionic material, preferably an anionic surfactant, more preferably linear alkylbenzene sulfonate, with a cationic material, preferably a cationic anhydrous liquid polymer. Preferably the mixture is made in an aqueous phase in the presence of an organic solvent and then further dried using a drying process described herein, preferably using an Agitated Thin Film Evaporator (ATFE), to produce an anhydrous binder. The anhydrous binder can then be combined with powders, such as citrates, carbonates, silicates, and the like, to form anhydrous agglomerates. Such a process provides anhydrous agglomerates that do not require a further drying step after the agglomeration step. These anhydrous agglomerates are useful in product forms including, but not limited to, liquid detergent products, especially anhydrous liquid detergent products, and in detergent tablet products.

Even yet another preferred aspect of the present invention, a process for making and/or drying surfactants or combinations of surfactants and/or other detergent adjunct ingredients such as chelants, builders, buffers, rheology modifiers and the like. Such a process comprises preparing a mixture of surfactants and/or other detergent adjuncts in an aqueous medium or a combination of aqueous and solvent media. This preparation step may be achieved by mixing these materials in their neutralized aqueous and/or powder form or by co-neutralizing them in the presence or absence of a solvent batchwise or continuously in a dominant bath neutralization loop such as a Chemithon, Ballestra or Manro unit. The drying step comprises feeding the prepared mixture into a drying device or equipment which is a batch or continuous drying equipment. An example of batch drying equipment is a combination tank preferably agitated, which can be heated under vacuum. The tank is operated at suitable vacuum and temperature such that water is stripped from the mixture. An example of a continuous drying equipment is an Agitated Thin Film Evaporator (ATFE). A suitable ATFE is commercially available from LCI Corporation. This process is also suitable for expanding hollow microspheres, such as EXPANCEL® microspheres. As the hollow microspheres pass through the drying equipment (ATFE) the microspheres expand because the temperature of the ATFE is above the expansion temperature of the microspheres.

Thus the compositions produced according to the processes disclosed herein the above benefits which are novel to non-aqueous compositions and yet these process produce compositions that are typical of a non-aqueous liquid laundry detergent composition, viz. a high surfactant activity and excellent additive stability.

In one embodiment, the process comprises a formation step in which an aqueous surfactant mixture is formed by mixing an anionic sulfonated surfactant, an organic solvent or carrier and a chelant and a drying step in which the aqueous surfactant mixture under vacuum to form a solvent-based surfactant paste containing less than about one percent, by weight, of water. This process may be modified such that an individual ingredient can be processed, thereby producing a "dried" ingredient. For example, an anionic sulfonated surfactant could be dried via the drying step such that the anionic sulfonated surfactant final product contains less than about 1% by weight of water.

The aqueous surfactant mixture in the formation step contains from about 5% to about 85% of an anionic sulfonated surfactant, from about 15% to about 95% of an organic solvent, from about 0.001% to about 40% of a chelant and at least about 15% of water by weight of the aqueous surfactant mixture. The aqueous surfactant mixture in the formation step is a non-Newtonian fluid.

The solvent-based surfactant paste produced by the drying step is a Newtonian fluid and having a substantially constant viscosity within the range of 100 cp to 100000 cp when measured at a temperature of 25° C. and within the shear rate range of from 1 $s^{-1}$ to 1000 $s^{-1}$.

A preferred embodiment also includes mixing into the aqueous surfactant mixture other additives such as buffers, builders, nonionic surfactants, polymers and copolymers and other additives.

The present invention may also be practiced in a second aspect. This embodiment comprises a neutralization step in which a neutralized mixture is formed by a continuous neutralization loop. This neutralized mixture contains an acid form of an anionic surfactant, a base, an organic solvent, and a chelant. The neutralized mixture has a water content of at least about 5% by weight of the neutralized mixture and is a non-Newtonian fluid. The molar ratio of the acid form of the anionic surfactant to the base is from about 1:1 to about 9:1.

In a subsequent step, a first portion of the neutralized mixture is then removed from the continuous neutralization loop and dried under vacuum to form a solvent-based surfactant paste having a water content of from about 0.2% to about 10% and which is in the form of a Newtonian fluid having a substantially constant viscosity within the range of 100 cp to 100000 cp when measured at a temperature of 25° C. and within the shear rate range of from 1 $s^{-1}$ to 1000 $s^{-1}$ while a second portion of the neutralized mixture is recirculated in the continuous neutralization loop.

If so desired, additional chelant and solvent may be added to the neutralized mixture after the neutralized mixture is removed from the neutralization loop.

The present invention offers the advantage of preparing a surfactant paste with only a trace amount of water and yet can incorporate many of the ingredients desirable for use in a laundry detergent composition such as bleach, bleach activators, builders, enzymes, whiteners and other additives. By minimizing the amount of water in the surfactant pastes or mixtures, one may maximize the activity of the surfactant paste. Furthermore, the present invention allows the manufacture of a high-active surfactant paste or mixtures in the form of a Newtonian Fluid that has a low viscosity and so is capable of being transported, stored and handled with ease.

All percentages, ratios and proportions herein are by weight, unless otherwise specified. All documents cited are, in relevant part, incorporated herein by reference.

DETAILED DESCRIPTION OF THE INVENTION

Definitions—As used herein, a "Newtonian fluid", is a fluid that within a range of specified shear rates at a specified temperature the viscosity of the fluid has a substantially constant value.

As used herein, a "non-Newtonian fluid", refers to a fluid which cannot be characterized as a "Newtonian fluid."

As used herein, "non-aqueous" or "anhydrous" are used synonymously and both describe a fluid in which the water content is less than about 5%.

The present invention describes a process for preparing non-aqueous liquid laundry detergents with additives by forming an aqueous surfactant mixture and then drying the mixture under a vacuum to form a non-aqueous solvent-based surfactant paste. The processes of preparing non-aqueous liquid laundry detergent compositions with additives has many important parameters and incorporates many different ingredients and additives as well as numerous other preferable and optional process subparts which are described hereafter.

Figure 1:
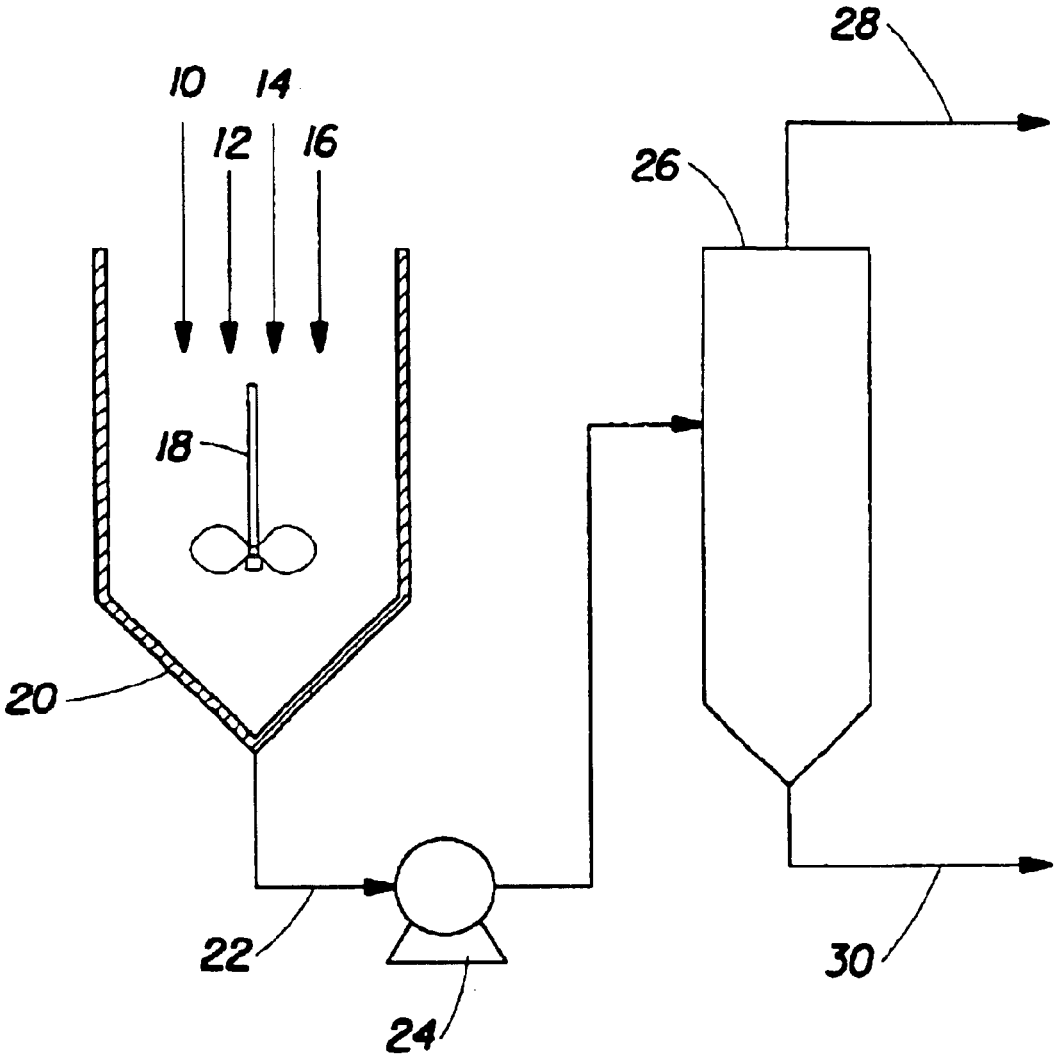
FIG. 1 is a schematic representation of an apparatus for carrying out the process according to the invention.

Referring now to FIG. 1 In the fast embodiment of the process, the formation step consists of adding several different ingredients 10, 12, 14 and 16 to a mixer 20 with an impeller stirrer 18 to form an aqueous surfactant mixture by mixing the formation step ingredients (described below) in the mixer. It is preferable that each of the ingredients be added in the form of a neutralized aqueous solution which is comprised of about 20% water, by weight. A modified process in accordance to the present invention comprises processing individual ingredients instead of a mixture of ingredients.

The first ingredient 10 in the formation step is an aqueous surfactant mixture. The final aqueous surfactant mixture will include, by weight, from about 5% to about 85%, more preferably from about 25% to about 75%, most preferably from about 40% to about 60% of anionic sulfonated surfactant. Suitable anionic sulfonated surfactants are discussed in greater detail below.

The second ingredient 12 in the formation step is an organic solvent. The final aqueous surfactant mixture will include, by weight, from about 15% to about 95%, more preferably from about 30% to about 70%, most preferably from about 40% to about 60% of an organic solvent. Suitable organic solvents are discussed in greater detail below.

The third ingredient 14 in the formation step is a chelant. The final aqueous surfactant mixture will include, by weight, from about 0.001% to about 40%, more preferably from about 0.01% to about 4%, most preferably from about 0.1% to about 2% of a chelant. Suitable chelants are discussed in greater detail below.

The third ingredient 16 in the formation step is composed of optional detergent additives such as bleach, bleach activator, buffers, builders, enzymes, nonionic surfactants, whiteners, rheology modifiers, polymers and copolymers. These are discussed in greater detail below.

The aqueous surfactant mixture in the formation step contains, by weight, at least about 15%, more preferably from about 18% to about 50% of water. The aqueous surfactant mixture in Step A may also contain other conventional detergent ingredients such as buffers, builders, nonionic surfactants, whiteners, rheology modifiers, polymers and copolymers and other additives, some of which are discussed in greater detail below. The aqueous surfactant mixture is formed by mixing together all of the ingredients in step A (in any order) into a substantially uniform mixture, at a temperature of between about 25° C. and about 80° C., preferably at a temperature of between about 35° C. and about 70° C. and most preferably at a temperature of between about 45° C. and about 60° C. Temperature control is important because if the temperature is too low, it will be difficult to process the mixture and if the temperature is too high there may be degradation of the solvent and/or the chelant component of the mixture.

The mixer 20 in the formation step is most preferably carried out in a standard mixer or crutcher. The speed of the mixer and the duration of the mixing step varies depending on the type of mixer and ingredients used. Mixing should be done at a speed and for a time sufficient to achieve a homogenous aqueous surfactant mixture.

The aqueous surfactant mixture 22 is then by the action of a pump 24 pumped into a drying device 26 where the drying step takes place. The drying step of the process is drying the aqueous surfactant mixture under vacuum to form a solvent-based surfactant paste containing less than about one percent, by weight, of water. This drying may be accomplished in any conventional evaporator, provided that the drying is performed under vacuum. Suitable evaporators are illustrated in Perry's Chemical Engineering Handbook, 7th. Ed., 1997, McGraw-Hill, ppg. 11–108 to 11–111, "Evaporator Types and Applications", which is herein incorporated by reference. A preferred evaporator is an agitated thin-film evaporator.

Suitable evaporators for use herein include forced-circulation evaporators, short-tube vertical evaporators, long-tube vertical evaporators, propeller, calandria, horizontal-tube evaporators, falling-film evaporators, spray-film evaporators channel-switching evaporators, Oslo-type crystallizer, agitated thin-film evaporators, submerged-combustion evaporators, disk evaporators, cascade evaporators, flash evaporators, and combinations thereof. Such evaporators are discussed in further detail in Perry's Chemical Engineering Handbook, $7^{th}$ Ed., 1997, McGraw-Hill, ppg. 11-108 to 11-111, "Evaporator types and Applications" which is herein incorporated by reference.

The drying step produces a solvent-based surfactant paste 30 which is a Newtonian fluid having a substantially constant viscosity within the range of 100 cp to 100000 cp when measured at a temperature of 25° C. and within the shear rate range of from 1 $s^{-1}$ to 1000 $s^{-1}$. The drying step also produces a combination of water vapor and other volatiles 28 which are subsequently condensed and the volatiles reclaimed.

Figure 2:
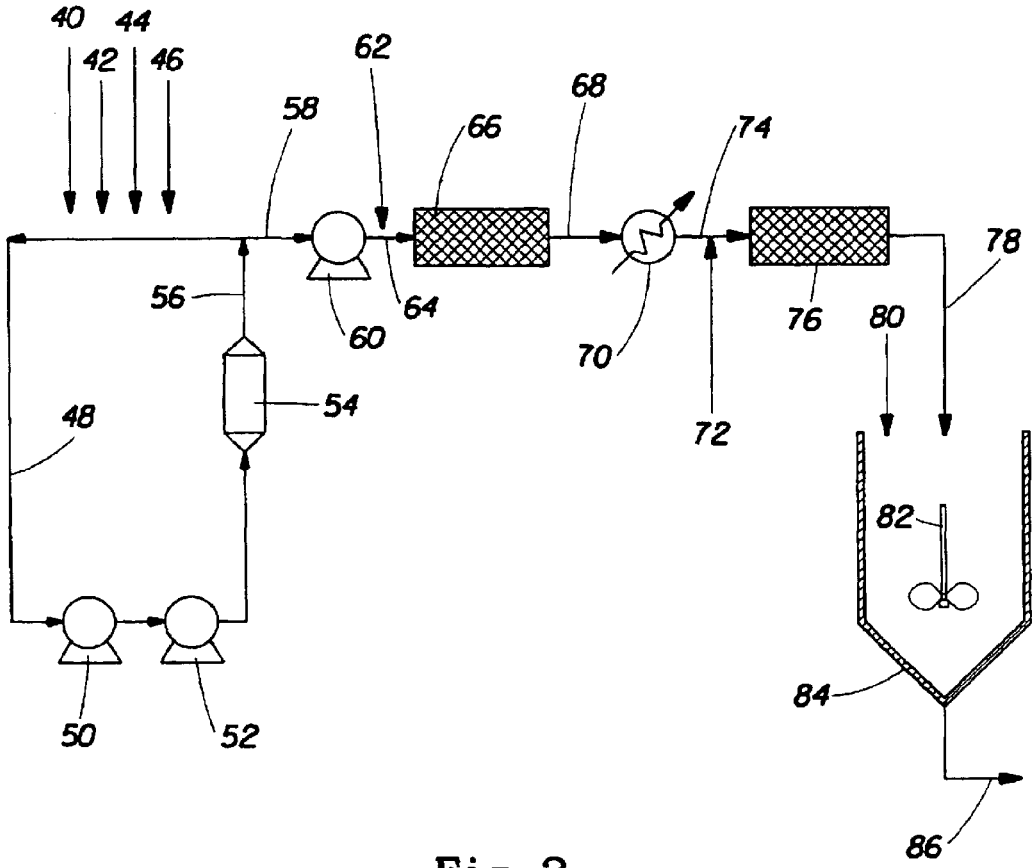
FIG. 2 is a schematic representation of an apparatus for carrying out the process according to the invention.

The processes of the present invention which produces a solvent-based surfactant paste can also be practiced in a second aspect which is depicted in FIG. 2. Referring now to FIG. 2, in the neutralization step of this aspect a neutralized mixture 58 is formed by a continuous neutralization loop. Four components are continuously added to the neutralization loop: an acid form of an anionic sulfonated surfactant 40, a base 42, an organic solvent 44, and a chelant 46 into the loop. A mixture of the components are formed as the components and mixture are circulated through a mixer 50 a pump 52 and a heat circulator 54. Neutralization takes place as the base reacts with the acid form of the surfactant to produce a surfactant salt. The resulting neutralized mixture has a water content of at least about 15% by weight of the neutralized mixture and is a non-Newtonian fluid.

A first portion of the neutralized mixture 56 is recirculated in the continuous neutralization loop while a second portion is removed from the continuous neutralization loop 58 by the action of a pump 60. If desired, additional organic solvent 62 or chelant 62 may be added to and mixed with the second portion of the neutralized mixture in a static mixer 66 with the resulting mixture 64 having a water content of from about 5% to about 50%, by weight The resulting mixture is then further mixed in a static mixer 66. Depending on the needs of the formulator, additional chelant 72 or organic solvent 72 may again be added to the second portion of the neutralized mixture and mixed in a static mixer 76 or a conventional mixer such as a crutcher 84.

The molar ratio of the acid form of the anionic surfactant to the base is from about 1:1 to about 9:1. It is preferable that these ingredients be added in the form of an aqueous solution. The aqueous solution of the various components which are added to the continuous neutralization loop (40, 42, 44, 46) will preferably comprise the following amounts of water:

| | |
|---|---|
| acid from of sulfonated surfactant | from about 0.0% to about 10.0% |
| base | from about 30% to about 90% |
| organic solvent | from about 0.0% to about 50% |
| chelant | from about 40% to about 95% |

The second portion of the neutralized mixture is then dried under vacuum to form a solvent-based surfactant paste having a water content of from about 0.2% to about 10% and which is in the form of a Newtonian fluid having a substantially constant viscosity within the range of 100 cp to 100000 cp when measured at a temperature of 25° C. and within the shear rate range of from 1 $s^{-1}$ to 1000 $s^{-1}$. The drying operation is similar to that described above and may use the same equipment and process variables.

The processes described above offer the advantage of preparing a surfactant paste with only a trace amount of water yet incorporating many of the ingredients desirable for use in a laundry detergent composition such as builders, whiteners and other additives. By minimizing the amount of water in the surfactant pastes, one may maximize the activity of the surfactant paste. Furthermore, the present invention allows the manufacture of a high-active surfactant paste in the form of a Newtonian Fluid that has a low viscosity and so is capable of being transported, stored and handled with case.

The process described herein may also be combined with other known detergent-manufacturing process step commonly used in the detergent industry for the manufacture of liquid or solid detergents in any from (e.g. granular, tablet etc.).

The solvent-based surfactant pastes described above comprise the following ingredients hereafter described in seritam.

Anionic Sulfonated Surfactants

Anionic sulfonated surfactants are added to the processes described herein in the form of aqueous liquids. Suitable anionic sulfonated surfactants include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Further anionic surfactants herein are the sodium alkyl glyceryl ether sulfonates, especially those ethers of higher alcohols derived from tallow and coconut oil; sodium coconut oil fatty acid monoglyceride sulfonates.

Other usefull anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of-olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization can be performed as part of the fine dispersion mixing step.

Particularly preferred surfactants herein include linear alkylbenzene sulfonates containing from about 11 to 14 carbon atoms in the alkyl group; tallow alkyl sulfates; coconutalkyl glyceryl ether sulfonates; olefin or paraffin sulfonates containing from about 14 to 16 carbon atoms; alkyldimethylamine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms and mixtures thereof.

Specific preferred surfactants for use herein include: triethanolammonium $C_{11}$–$C_{13}$ alkylbenzene sulfonate; sodium coconut alkyl glyceryl ether sulfonate; sodium coconut alkyl glyceryl ether sulfonate; the condensation product of a $C_{12}$–C13 fatty alcohol with about 3 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; and mixtures thereof.

Non-surfactant Non-aqueous Organic Solvents

The liquid phase of the detergent compositions herein may also comprise one or more non-surfactant, non-aqueous organic solvents. The detergent compositions of the present invention will contain from about 15% to about 95%, more preferably from about 30% to about 70%, most preferably from about 40% to about 60% of an organic solvent. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents usefull in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol(4-methyl-2,4-pentanediol), 1,6-hexanediol, 1,3-butylene glycol and 1,4butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

Chelants

The detergent compositions herein also contain a chelating agent which serves to chelate metal ions, e.g., iron and/or manganese, within the non-aqueous detergent compositions herein. The detergent compositions will contain from about 0.1% to about 10%, more preferably from about 0.5% to about 5%, most preferably from about 1% to about 3% of a chelant. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof Other suitable chelants are disclosed in U.S. Pat. Nos. 5,712,242, issued Jan. 27, 1998, to Aouad et al., which is incorporated herein by reference.

Amino carboxylates useful as optional chelating agents include hylenediaminetetraacetates, N-hydroxyethylethylenediaminetriacetates, nitrilotriacetates, ethylenediamine tetraproprionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Neutralization Bases

In one embodiment of this invention the acid from of a surfactant reacts with a neutralization base. Any base which adequately neutralizes the acid form of the surfactant is at suitable. Preferred neutralization bases include the alkali metal carbonates, alkali metal hydroxides and alkali metal phosphates, e.g., sodium carbonate, sodium hydroxide, sodium polyphosphate.

Optional Composition Components

In addition to the components described above, the present detergent compositions can, and preferably will, contain various other optional components. Such optional components are added to the detergent compositions in the form of dilute aqueous solutions.

(a) Organic Detergent Builders

Another possible type of additional particulate material which can be suspended in the non-aqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the SOKALAN™ which have molecular weight ranging from about 5,000 to 100,000.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the additional particulate material, insoluble organic detergent builders can generally comprise from about 2% to 20% by weight of the compositions herein. More preferably, such builder material can comprise from about 4% to 10% by weight of the composition.

(b) Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

(c) Polymers and/or Co-polymers

The polymers and copolymers of the present invention may be chosen from a wide range of organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyvinyl alcohols (which often also include some polyvinyl acetate), polyacrylamides, polyacrylates, polyaspartates, polyvinylpyrrolidones and various copolymers, such as those of maleic and acrylic acids. Molecular weights for such polymers vary widely but most are within the range of 2,000 to 100,000.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Most preferred for use in the present invention are copolymers of maleic and acrylic acid having a molecular weight of from 2000 to 100000, carboxymethyl cellulose and mixtures thereof. The concentration of the aqueous solutions of the polymer or copolymer is not critical in the present invention. However, it is convenient to use solutions which are readily available commercially.

Another suitable class of polymers which is especially useful in processes of the present invention where an anhydrous agglomerate is desired is anhydrous liquid polymers, preferably cationic anhydrous liquid polymers. Such anhydrous liquid polymers are known to those of ordinary skill in the art Aqueous solutions having a concentration of from 5% to 60% of the polymer or copolymer are suitable.

(d) Optional Brighteners, Suds Suppressors, and/or Dyes

The detergent compositions herein may also optionally contain conventional brighteners, suds suppressors, bleach catalysts, dyes and/or perfume materials. Such brighteners, suds suppressors, silicone oils, bleach catalysts, dyes and perfumes must, of course, be compatible and non-reactive with the other composition components in a non-aqueous environment. If present, brighteners suds suppressors, dyes and/or perfumes will typically comprise from about 0.0001% to 2% by weight of the compositions herein. Suitable bleach catalysts include the manganese based complexes disclosed in U.S. Pat. No. 5,246,621, U.S. Pat. No. 5,244,594, U.S. Pat. No. 5,114,606 and U.S. Pat. No. 5,114,611.

The following example is illustrative of the present invention, but is not meant to limit or otherwise define its scope. All parts, percentages and ratios used herein are expressed as percent weight of the composition unless otherwise specified.

EXAMPLE 1

This process is comprised of two key steps. In the first step raw materials in form of aqueous solutions are combined at a typical batch size of 2400 lb. In the second step, the water is removed from the aqueous feed stock. In the mixing step, at room temperature, n-butoxy propoxy propanol (BPP) at a minimum purity of 99% is added to a 50% active aqueous solution of the sodium salt of linear alkyl benzene sulfonate (LAS). The solution is mixed until it appears homogeneous. Next, a 36.25% active aqueous solution of [S, S]-ethylenediamino-N-N'-disuccinic acid (EDDS) chelant is added, and the resulting solution is mixed until it appears homogeneous. The EDDS chelant is added to the other two components at room temperature, and contains a minimum of 99% S,S isomer of the total EDDS isomers and a minimum of 95% S,S isomer of the total amino acid species. The formula details for the resulting aqueous solution are summarized below.

TABLE 1

Composition of Aqueous Solutions

| Component | LAS Solution | BPP | EDDS Solution |
|---|---|---|---|
| Activity of Aqueous Solution (%) | 50 | 100 | 36.25 |
| Amount in Aqueous Solution Added (lb) | 1631 | 545 | 225 |
| Amount on Dry Basis (%) | 56.6 | 37.7 | 5.7 |

The water is removed from the aqueous mixture in a 5.4 $ft^2$ steam-jacketed agitated thin film evaporator. The aqueous solution is pumped at a rate of 115 kg/hr to the evaporator, operating at a temperature of 160° C. and a pressure of 100 mm Hg. The product exits the evaporator at a temperature of 120° C. with a moisture content of 0.6%. The product is then cooled in a plate and frame heat exchanger to 35° C. About 14% of the BPP evaporates with the water in the ATFE. The remaining dried product composition is shown in Table 2. The table indicates that LAB and $Na_2SO_4$ are present in the dried product. LAB is linear alkyl benzene (LAB) alcohol, it is left over from the sulphonation reaction which produces HLAS. $Na_2SO_4$ is a by-product of the reaction between HLAS and NaOH which produces NaLAS.

TABLE 2

| Composition of Dried Product | | | | | | |
|---|---|---|---|---|---|---|
| Component | NaLAS | BPP | EDDS | $Na_2SO_4$ | LAB | Water |
| Amount (%) | 58.7 | 33.3 | 5.9 | 0.92 | 0.59 | 0.6 |

EXAMPLES 2–6

In the following Examples 2–6, fatty alcohol was sulfated to make a C11–C13 fatty acid of linear alkylbenze sulfonate ("HLAS") having a completeness and acid value of 97 and 172.14 respectively. The acid was neutralized in a continuous neutralization system such as a neutralization loop available from the Chemithon Corporation, Seattle. Wash., USA in the presence of an organic solvent/carrier as well as a chelant. Drying of the mixture exiting the loop was then dried in an agitated thin film evaporator ("ATFE") such as the one supplied by LCI Corporation, Charlotte, N.C., USA.

The resulting detergent compositions produced were then analyzed as follows: in all examples, Karl Fischer analysis was used to determine amount of residual water. A rotational rheometer, Cari-med, supplied by TA Instruments, Delaware, USA was used to measure rheology.

EXAMPLE 2

The HLAS was neutralized with 50% solution of NaOH while co-adding an organic solvent n-butoxy propoxy propanol ("n-BPP") produced by the Dow Chemical of Midland, Mich. and a 37% solution of the sodium salt of [S,S]-ethylenediamino-N-N'-disuccinic acid ("NaEDDS"). After neutralization the resulting mixture comprised, on a weight basis:

| Ingredient | Amount (%) |
|---|---|
| NaLAS | 46.8 |
| BPP | 31.44 |
| NaEDDS | 4.5 |
| Water | 16 |
| Miscellaneous Minors | Balance |

The combined flow rate of all components into the neutralization loop at room temperature was 1.034 kg/min. The temperature of neutralization was 99° F. while the temperature of the mixture exiting the loop was 95° F. The mixture exiting the loop was non-Newtonian as shown in the figure below. Also shown is a figure particle size distribution as measured by a Coulter LS particle size analyzer. The mixture is then fed continuously at a rate of 120 kg/hr into a 3 $ft^2$ ATFE) operating at 160° C. and 95 mmHg. The resulting dry material contained 0.45% water and behaved as a Newtonian fluid having a viscosity of 15,000 cP at room temperature as measured by a rotational rheometer. Also shown is a particle size distribution measurement of the dry material.

EXAMPLE 3

HLAS was neutralized with 50% solution of NaOH while co-adding BPP. After neutralization the resulting mixture comprised, on a weight basis:

| Ingredient | Amount (%) |
|---|---|
| NaLAS | 53.4 |
| BPP | 35.6 |
| Water | 10 |
| Miscellaneous Minors | Balance |

The combined flow rate of all components into the neutralization loop at room temperature was 0.906 kg/min. The temperature of neutralization was 99° F. while the temperature of the mixture exiting the loop was 95° F. The mixture exiting the loop was non-Newtonian as shown in the figure below. The material was further mixed in a tank with a solution of NaEDDS to give a composition similar to that in the above example. The resulting rheology was also non-Newtonian. Also is a figure showing particle size distribution as measured by a Coulter LS particle size analyzer. The mixture was then fed continuously at a rate of 137 kg/hr into a 3 $ft^2$ ATFE operating at 160° C. and 95 mmHg. The resulting dry material contained 0.77% water and behaved as a Newtonian fluid having a viscosity of 12,000 cP at room temperature as measured by a rotational rheometer. Also shown is a particle size distribution measurement of the dry material.

EXAMPLE 4

HLAS was neutralized with 50% solution of NaOH while co-adding BPP. After neutralization the resulting mixture comprised, on a weight basis:

| Ingredient | Amount (%) |
|---|---|
| NaLAS | 53.4 |
| BPP | 35.6 |
| Water | 10 |
| Miscellaneous Minors | Balance |

The combined flow rate of all components into the neutralization loop at room temperature was 0.906 kg/min. The temperature of neutralization was 99° F. while the temperature of the mixture exiting the loop was 95° F. The mixture exiting the loop was non-Newtonian as shown in the figure below. Also is a figure showing particle size distribution as measured by a Coulter LS particle size analyzer. The mixture is then fed continuously at a rate of 170 kg/hr into a 3 $ft^2$ ATFE operating at 160° C. and 95mmHg. The resulting dry material contained 0.7% water and behaved as a Newtonian fluid having a viscosity of 10,000 cP at room temperature as measured by a rotational rheometer. Also shown is a particle size distribution measurement of the dry material.

EXAMPLE 5

A mixture was prepared comprising on a weight basis:

| Ingredient | Amount (%) |
|---|---|
| NaLAS | 32.7 |
| BPP | 50.8 |
| NaDTPA | 3.4 |

-continued

| Ingredient | Amount (%) |
|---|---|
| Water | 11.2 |
| Miscellaneous Minors | Balance |

The mixture was then fed continuously at a rate of 156 kg/hr into a 3 $ft^2$ ATFE operating at 156° C. and atmospheric pressure. The resulting dry material contained 2.3% water.

EXAMPLE 6

A mixture was prepared comprising, on a weight basis:

| Ingredient | Amount (%) |
|---|---|
| NaLAS | 34.8 |
| BPP | 54.2 |
| NaEDDS | 1.16 |
| Water | 7.8 |
| Miscellaneous Minors | Balance |

153 kg of this material was charged into a stirred tank where it was dried batch-wise at 100° C. and 28 mmHg. The resulting dry material contained 0.25% water.

EXAMPLES 7–10

At room temperature, BPP, at a minimum purity of 99% is added to and mixed with a 50% active aqueous solution of the sodium salt of C11–C13 fatty acid of NaLAS (CALSOFT™ L-50, from Pilot Chemical Co., Middletown, Ohio) ("LAS"). The solution is mixed until it appears homogeneous. Next, an active aqueous solution of EDDS chelant is added to the aqueous mixture, and the resulting solution is mixed until it appears homogeneous. The EDDS chelant is added to the other two components at room temperature, and contains a minimum of 99% S,S isomer of the total EDDS isomers and a minimum of 95% S,S isomer of the total amino acid species.

The water is removed from the aqueous mixture in a 5.4 $ft^2$ steam-jacketed agitated thin film evaporator such as the one supplied by LCI Corporation, Charlotte, N.C. The aqueous solution is pumped at a rate of 115 kg/hr to the evaporator, operating at a temperature of 160° C. and a pressure of 100 mm Hg. The product exits the evaporator at a temperature of 120° C. with a moisture content of 0.6%. The product is then cooled in a plate and frame heat exchanger to 35° C. About 14% of the BPP evaporates with the water in the ATFE. The remaining dried product composition comprises, on a weight basis:

EXAMPLE 7

A mixture was prepared comprising, on a weight basis:

| Ingredient | Amount (%) |
|---|---|
| NaLAS | 42 |
| BPP | 28 |
| Water | 29 |
| Miscellaneous Minors | Balance |

The mixture was then fed continuously at a rate of 217 kg/hr into a 5.5 $ft^2$ ATFE operating at 160° C. and 102 mmHg. The resulting dry material contained 0.47% water and had a Newtonian viscosity of 4600 cP.

EXAMPLE 8

A mixture was prepared comprising, on a weight basis:

| Ingredient | Amount (%) |
|---|---|
| NaLAS | 36.23 |
| BPP | 24.15 |
| NaEDDS | 1.93 |
| Water | 34.3 |
| Miscellaneous Minors | Balance |

The mixture was then fed continuously at a rate of 130 kg/hr into a 5.5 $ft^2$ ATFE operating at 150° C. and 100 mmHg. The resulting dry material contained 0.7% water and had a Newtonian viscosity of 10,000 cP.

EXAMPLE 9

A 78% high active paste of the sodium salt of $C_{11}$–$C_{13}$ fatty acid of linear alklylbenze sulfonate (NaLAS) was mixed with an organic solvent/carrier as well as a chelant to form the following mixture, on a weight basis:

| Ingredient | Amount (%) |
|---|---|
| NaLAS | 44.7 |
| BPP | 29.8 |
| NaEDDS | 4.47 |
| Water | 19 |
| Miscellaneous Minors | Balance |

The mixture was then fed continuously at a rate of 56.7 kg/hr into a 5.5 $ft^2$ ATFE operating at 120° C. and 34 mmHg. The resulting dry material contained 0.31% water and had a Newtonian viscosity of 6400 cP.

EXAMPLE 10

A 78% high active paste of the sodium salt of $C_{11}$–$C_{13}$ fatty acid of linear alkylbenze sulfonate (NaLAS) was mixed with an organic solvent/carrier as well as a chelant to form the following mixture, on a weight basis:

| Ingredient | Amount (%) |
|---|---|
| NaLAS | 41.6 |
| BPP | 32 |
| NaEDDS | 3.84 |
| Water | 20 |
| Miscellaneous Minors | Balance |

The mixture was then fed continuously at a rate of 65 kg/hr into a 5.5 $ft^2$ ATFE operating at 140° C. and 55 mmHg. The resulting dry material contained 0.69% water and had a Newtonian viscosity of 2400cP.

What is claimed is:

1. A process for preparing a solvent-based surfactant paste comprising the steps of:

A) forming an aqueous surfactant mixture by blending, by weight of the mixture:

(a) from about 5% to about 85% of an anionic sulfonated surfactant;

(b) from about 15% to about 95% of an organic solvent;

(c) from about 0.001% to about 40% of a chelant;

wherein the aqueous surfactant mixture a water content of about 5% to 80% by weight of the aqueous surfactant mixture and the aqueous surfactant mixture is a non-Newtonian fluid;

B) drying the aqueous surfactant mixture under vacuum to form the solvent-based surfactant paste having a wafer content of less than about 1% and which is in the form of a Newtonian fluid having a substantially constant viscosity within the range of 100 cp to 100000 cp when measured at a temperature of 25° C. and within the shear rate range of from 1 $s^{-1}$ to 1000 $s^{-1}$.

2. The process of claim 1 wherein the aqueous surfactant mixture may further comprise from about 0.001% to about 40% of other additives selected from the group comprising bleach, bleach activator, buffers, builders, enzymes, whiteners, rheology modifiers, polymers and copolymers, wherein the other additives are provided in the form of an aqueous solution.

3. The process of claim 1 wherein the aqueous surfactant mixture is dried in an evaporative column.

4. The process of claim 1 wherein the step of forming an aqueous surfactant mixture includes blending from about 0.001% to about 40% of an ethoxylated hexamethylene diamine quaternary ammonium compound.

5. The process of claim 1 wherein the step of forming an aqueous surfactant mixture includes blending from about 0.001% to about 40% of other additives selected from the group comprising bleach, bleach activator, builder, enzymes, nonionic surfactants, whiteners and polymers.

6. The process of claim 1 wherein the organic solvent is selected from a group consisting of alkylene glycols, diethyl- and dipropylene glycol monobutyl ethers, glycol monobutyl ether, monoethylethers, monomethylethers, monopropylethers and monobutylethers of propoxy propanol, polyethlene glycols having a molecular weigh of at least about 150, methyl acetate, methyl propoinate, methyl octanoate, methyl dodecanoate and mixtures thereof.

7. The process of claim 1 wherein the chelant is selected from a group consisting of amino carboxylates, phosphonates, amino phosponates, polyfunctionally-substituted aromatic chelating agents and mixtures thereof.

8. A process for preparing a solvent-based surfactant paste comprising the steps of:

A) forming a neutralized mixture by a continuous neutralization loop, the neutralized mixture has a composition comprising:

(d) an acid form of an anionic sulfonated surfactant and a base present in a molar ratio of from about 1:1 to bout 9:1;

(e) an organic solvent; and (f) a chelant;

wherein the neutralized mixture has a water content of from about 5% to about 50% by weight of the neutralized mixture and is a non-Newtonian fluid.

B) recirculating a first portion of the neutralized mixture;

C) removing a second portion of the neutralized mixture from the continuous neutralization loop;

D) drying the second portion of the neutralized mixture under vacuum to form the solvent-based surfactant paste having a water content of from about 0.2% to about 10% and which is in the form of a Newtonian fluid having a substantially constant viscosity within the range of 100 cP to 100000 cP when measured at a temperature of 25° C. and within the shear rate range of from 1 $s^{-1}$ to 1000 $s^{-1}$.

9. The process of claim 8 where the neutralized mixture further comprises other additives selected from the group comprising bleach, bleach activator, buffers, builders, enzymes, nonionic surfactant, whiteners, rheology modifiers, polymers and copolymers, wherein the other additives are provided in the form of an aqueous solution which has a water content of from about 5% to about 50% by weight of the neutralized mixture.

10. The process of claim 8 wherein the second portion of neutralized mixture is dried in an evaporative column.

11. The process of claim 8 wherein the acid form of an anionic surfactant is selected from a group consisting of linear alkyl benzene sulphonic acid, alkyl ethoxy sulphonic acid, alkyl polyalkxylate sulphonic acid, tallow alkyl sulphonic acid and alkyl sulphonic acid.

12. The process of claim 8 wherein the organic solvent is selected from a group consisting of alkylene glycols, diethyl- and dipropylene glycol monobutyl ethers, glycol monobutyl ether, monoethyl-, monomethyl-, monopropyl- and monobutylethers of propoxy propanol and mixtures there of, polyethlene glycols having a molecular weight of at least about 150, methyl acetate, methyl propoinate, methyl octanoate and methyl dodecanoate.

13. The process of claim 8 wherein the chelant is selected from a group consisting of amino carboxylates, phosphonates, amino phosponates, polyfunctionally-substituted aromatic chelating agents and mixtures thereof.

14. The process of claim 8 wherein after step C additional organic solvent is added to the neutralized mixture, so that after the addition of the additional organic solvent the neutralized mixture has a water content of from about 5% to about 50% by weight of the neutralized mixture.

15. The process of claim 8 wherein after step C additional chelant is added to the neutralized mixture, so that after the addition of the additional chelant the neutralized mixture has a water content of from about 5% to about 50% by weight of the neutralized mixture.

16. The process of claim 1 wherein the aqueous surfactant mixture is dried using an agitated thin film evaporator.

17. The process of claim 8 wherein the second portion of neutralized mixture is dried using an agitated thin film evaporator.

* * * * *